US005789032A

United States Patent [19]

Le Cong et al.

[11] Patent Number: 5,789,032

[45] Date of Patent: Aug. 4, 1998

[54] MOLDLESS COATED BOARD

[75] Inventors: Hai Le Cong, Reseda; Arthur Jack Grigler, La Mirada, both of Calif.

[73] Assignee: Excelstone International, Inc., Sante Fe Springs, Calif.

[21] Appl. No.: 717,001

[22] Filed: Sep. 20, 1996

[51] Int. Cl.[6] ..... B05D 3/12; B05D 5/00; B05D 1/36

[52] U.S. Cl. ..... 427/346; 427/280; 427/181; 427/203; 427/205; 427/419.5; 523/171; 523/500; 524/437

[58] Field of Search ..... 427/346, 256, 427/280, 281, 393, 181, 203, 205, 419.5; 428/2, 15; 523/355, 171; 524/500, 437

[56] References Cited

U.S. PATENT DOCUMENTS

| | | | |
|---|---|---|---|
| 3,219,735 | 11/1965 | Iverson et al. | 427/346 |
| 3,344,570 | 10/1967 | Marson | 52/315 |
| 3,904,791 | 9/1975 | Iverson et al. | 427/277 |
| 4,085,246 | 4/1978 | Buser et al. | 428/220 |
| 4,097,648 | 6/1978 | Pringle | 428/2 |
| 4,235,948 | 11/1980 | Holmes | 427/204 |
| 4,301,198 | 11/1981 | Prior | 428/2 |
| 4,446,177 | 5/1984 | Munoz et al. | 428/15 |
| 4,499,142 | 2/1985 | Kingston | 428/331 |
| 4,590,726 | 5/1986 | Salazar | 52/314 |
| 4,643,921 | 2/1987 | Terabe et al. | 428/15 |
| 4,647,000 | 3/1987 | Osada | 428/15 |
| 4,652,596 | 3/1987 | Williams et al. | 523/348 |
| 4,908,257 | 3/1990 | Baskin | 428/15 |
| 4,916,172 | 4/1990 | Hayashi et al. | 523/171 |
| 5,028,459 | 7/1991 | Lathrop | 428/15 |
| 5,043,377 | 8/1991 | Nogi et al. | 524/437 |
| 5,055,324 | 10/1991 | Stecker | 427/281 |
| 5,073,587 | 12/1991 | Edwards | 524/166 |
| 5,122,395 | 6/1992 | Sandor | 427/267 |
| 5,244,941 | 9/1993 | Bruckbauer et al. | 523/171 |
| 5,304,592 | 4/1994 | Ghahary | 524/437 |
| 5,314,729 | 5/1994 | Ikezoe et al. | 428/15 |
| 5,321,055 | 6/1994 | Slocum | 523/171 |
| 5,344,704 | 9/1994 | O'Dell et al. | 427/280 |
| 5,356,953 | 10/1994 | Harada et al. | 523/171 |
| 5,358,993 | 10/1994 | Timm et al. | 524/445 |
| 5,393,807 | 2/1995 | Farrell | 524/2 |
| 5,424,365 | 6/1995 | Elmore et al. | 525/208 |
| 5,444,115 | 8/1995 | Hu et al. | 524/437 |
| 5,465,544 | 11/1995 | Ghahary | 52/311.1 |
| 5,476,895 | 12/1995 | Gharary | 524/437 |
| 5,637,236 | 6/1997 | Lowe | 428/15 |
| 5,648,144 | 7/1997 | Maurer et al. | 428/15 |

*Primary Examiner*—Diana Dudash
*Attorney, Agent, or Firm*—Christie, Parker & Hale, LLP

[57] ABSTRACT

There is provided coated substrate where a filled flowable polyester composition is cured in contact with and bonded to the substrate. The composition contains 20 to 40% resin and in excess of 50% filler, the balance being welling agent, air release agent and catalyst.

18 Claims, 2 Drawing Sheets

MOLDLESS COATED BOARD

FIELD OF THE INVENTION

The invention relates to cured, filled polymeric coatings, which resemble artificial stone, granite or marble. Liquid compositions are cured in contact with and bonded to a supporting substrate. The products are used as building materials.

BACKGROUND OF THE INVENTION

Artificial polished stone, in solid colors, simulated marble or granite rock, are used as building materials for products such as counter tops, vanity tops, cabinet, wall panels and coverings, furniture and the like. Such surfaces comprise a filled polymer composition which may be cured (crosslinked or thermoset) or uncured. In the past such compositions have been set or cured in a mold. The molded article was then removed and secured to a supporting surface. Such articles are costly to make and difficult to transport and install. Moreover, the use of a mold has been considered essential to obtain the glossy, polished look free of imperfections such as bubbles.

Artificial stone, marble and granite products are disclosed, for instance, in U.S. Pat. Nos. 4,085,246, issued Apr. 18, 1978 to Buser et al. 5,043,377 issued Aug. 27, 1991 to Nogedal; 5,424,365, issued Jun. 13, 1995; 5,244,941, issued Sep. 14, 1993 to Brackbarber et al.; 5,321,055, issued Jun. 14, 1994 to Donald H. Slocum; 4,643,921, issued Feb. 17, 1987 to Terable et al. and 5,304,592 issued Apr. 19, 1994 to Ghahary; 5,465,544 issued Nov. 14, 1995 to Ghahary and 5,476,895, issued Dec. 19, 1995 to Safas Corp., each incorporated herein by reference.

While such compositions produce quality products such as Corian™, they are fragile, requiring manufacture of slabs sufficiently thick to enable transporting. Even at that, the breakage rate is high, which explains in part the high cost, since breakage during transit, while not directly paid for by the consumer, is indirectly passed on to the consumer in higher per-square-foot costs. Indeed, costs of such surfaces on a square-foot basis exceed that of tile and may equal or exceed natural stone, marble and granite surfaces.

It would be desirable to provide artificial stone, marble and granite surfaces directly adhered to and formed on the substrate to which they are applied so that thickness and therefore costs can be reduced. In addition, the substrate will support the surface in the form of a laminate and reduce if not eliminate breakage during transit. It is required, however, that such product be produced at low cost and be workable both at the factory and on site.

The development of compositions which can be cast on to or cured directly on and bonded to the surface of the substrate is the subject matter of the instant invention.

SUMMARY OF THE INVENTION

The present invention is directed to artificial stone, marble and granite-appearing coated substrates in which the coating is formed of a filled liquid curable polyester composition cured in contact with and simultaneously bonded to the substrate to form a laminate having a cured solid surface which is aggressively adhered to the substrate. The composition, comprises about 20 to about 50% of a curable polyester resin, from 0 to about 2%, preferably from about 0.25 to about 1.5%, more preferably about 0.5% of a wetting agent; a positive amount up to about 2% by weight, preferably about 0.5% catalyst by weight; and from about 0.25 to about 1% by weight, preferably about 0.5% air release agent, the balance of the composition being filler which is preferably a hydrated alumina and/or casting chips and the like colorants. The composition is formed as a flowable liquid and deposited onto the substrate and is allowed to flow over the surface of the substrate and contained by a retaining form. Vibratory action is used to enhance flow and insure good wetting of the substrate surface. Five to ten minutes of vibration is typically employed. The applied composition is gelled then cured for about two or more hours at 160° to 180° F. The cured coating can be sanded, polished and cut into desired shapes. In a typical construction, an internal or peripheral frame or form is employed to control the height of the coating relative to the surface of the substrate. Substrates employed include plywood, particle board, medium-density fiber board (MDF board), tile board, masonite, clay, tile, woven glass fiber, and the like.

The reverse method of the invention eliminates the need for molds such as fiberglass mold, thus allowing the product to be manufactured economically. The dense solid surface is heat-resistant, abrasion-resistant, stain-resistant and can be sanded and polished to correct any imperfections. The finished article can then be cut to any desired length or width within its dimensions similar to cutting wood and does not require expert installers to achieve a finished look for kitchen, bath and vanity counter tops.

BRIEF DESCRIPTION OF THE DRAWINGS

Attached

DETAILED DESCRIPTION

This invention is directed to a pre-coated substrates formed by mixing a filled liquid curable composition, coating the composition on a supporting substrate, curing the liquid in contact with the substrate and simultaneously bonding the cured solid composition to the substrate. Substrates include particle board, medium density fiber board (MDF board), plywood, masonite, tile, fiberglass mats and the like. The formed precoated board can be used for products such as counter tops, cabinets, wall panels, furniture, and the like.

The method of making the precoated substrate involves the preparation of a filled liquid curable coating composition comprising the resin, filler in the form of colored chips, and/or alumina trihydrate (ATH), wetting agent, air releasing agent and catalyst. An external or internal form or frame is used to form a border or dam along the edges or on the surface of the substrate to define the thickness of the coating. The construction is placed on a work surface fitted with attached vibrator. The coating composition is poured within the form onto the article, and with vibratory action provided by the vibrator, the composition is spread, leveled and allowed to uniformly wet the substrate. Spreading may be aided by a screed. In consequence, the coating is spread evenly and quickly before becoming gelled by initiation of cure by action of the catalyst. The coated substrate then goes through a curing process to dry and harden and form a substantially flat board with a dense coated solid surface. The board is then sanded and/or polished to achieve a smooth surface of a desired height.

The thermoset plastic coating mixture can be used to bond sections of the coated substrate, as patching materials to repair cracks, nicks and other physical defects on the board. It can also be used as grout materials to seal the edges between the precoated boards on wall panels or counter tops by applying the same on the cracked boards or between separate boards that are joined. Then, through a sanding process, a seamless product can be formed. The composition may be used as a grout between coated tiles to form a seamless surface.

The cured solid surface has an exceptional quality which is virtually scratch resistant, stain resistant, heat resistant, chip resistant, and superior in hardness.

Also, the board can be attached to a custom designed edge of the same or different materials attached to the board. Alternatively, the edge can be made by other substances such as plastic or wood which are glued onto the edge of the board. The use of inlays is equally feasible.

Figure 1:
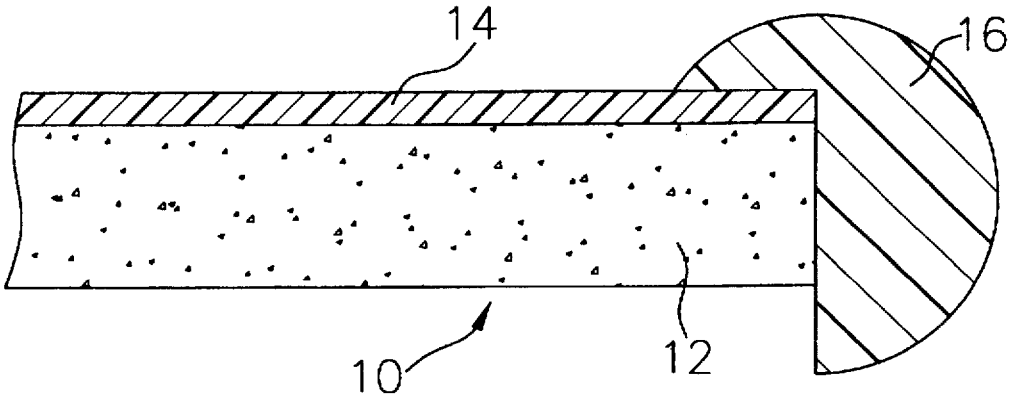
FIG. 1 is a side-view of currently preferred construction for a counter top.
Figure 2:
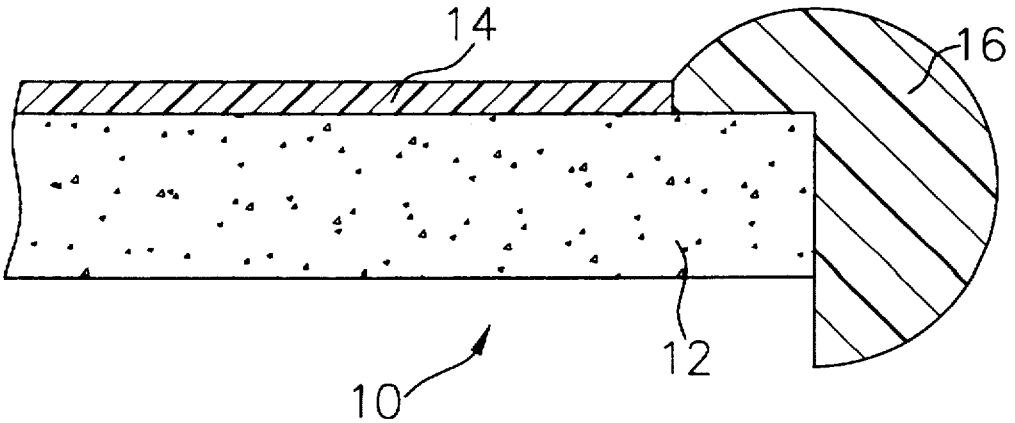
FIG. 2 is an alternate construction of FIG. 1.

The preferred construction of the invention is shown in FIG. 1. Countertop 10 is formed of particle board 12 having thereon and bounded thereto the cured compositions of the invention 14. This is in turn secured to, preferably by adhesive bonding, a bullnose edge 16 nominally of a diameter of about 1.5 inches and rising above the surface of the resin coating at about ⅛th of an inch. In FIG. 2 it shows the same arrangement, but bull nose edge 16 abuts rather than overlaps the coating 14. The bull nose edge 16 may be made of any material, including those of the invention and contain decorative inlays and the like.

Figure 3:
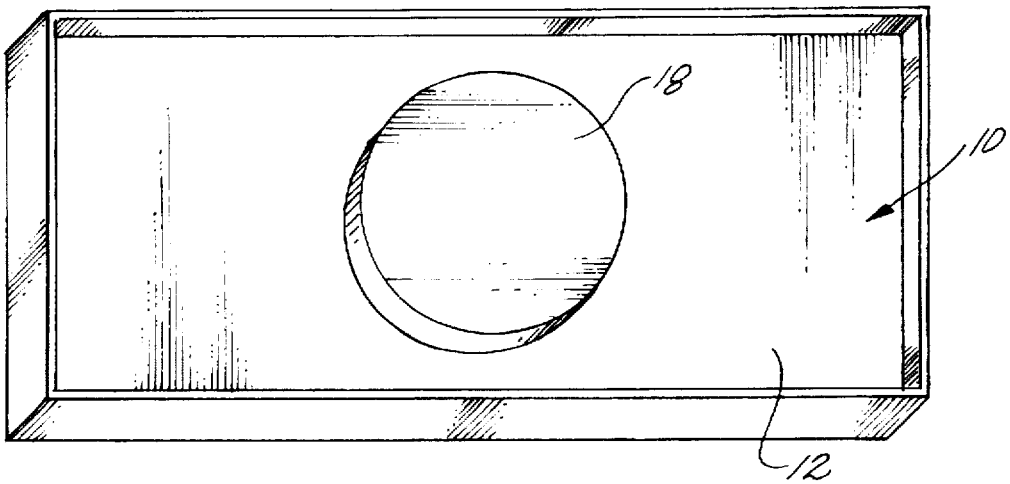
FIG. 3 shows inlays on a substrate.
Figure 4:
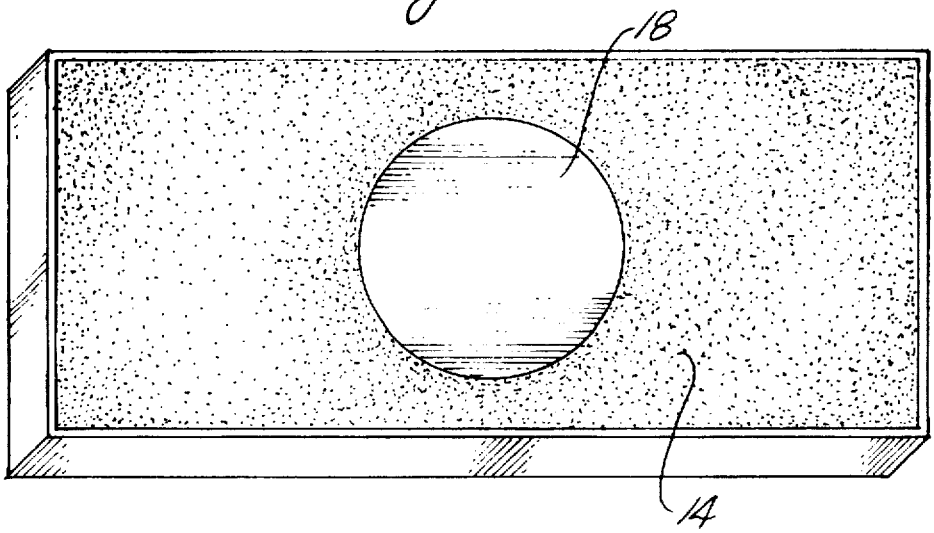
FIG. 4 shows the inlay of FIG. 3 surrounded by the coating composition.

Before applying the mixture out on the substrate, one or more pieces of sandable inlays having a thickness equal about the same as the coated mixture, preferably about ⅛", can be adhered on the substrate in a predetermined position. Inlays can be of any shape and design, including, for instance, grapevine, flower, angel, modern art or company logo and the like. Inlays may be made of sandable materials such as wood, plastic and the like. The coating process is then followed until coating thickness reach at least the same level of the inlays (attached FIG. 3 shows inlay 18 on substrate 12 while FIG. 4 shows inlay 18 in applied coating 14).

Alternatively, the coating can be applied first and inlays be inserted in the coating prior to setting.

After curing, the board is sanded and polished to achieve a smooth surface of a desired height.

This method achieves an ornamental design on the substrate with the least time consumed. This is important to economics. While the use of other solid surface such as Corian™ is popular it is extremely expensive. These materials are generally sold in sheet form and it is necessary by highly skilled labor to add inlays. The process of inlaying has extended the use of inlays to any shapes and designs as inlays can be made of any sandable material. Inserting these inlays on the surface is simple and does not require the use of hand tools such as a router or the like.

The composition of the invention comprises from about 20 to about 50% by weight of the curable (thermosettable) polyester resin from 0 to about 2% by weight, preferably about 0.25 to about 1.5% by weight, more preferably from about 0.5 present by weight of a wetting agent; and about 0.25 to about 1% by weight, preferably about 0.5% by weight of a degassing) or air release agent and a catalyst in a positive amount of up to about 2% by weight of the composition. The balance of the composition is filler.

Filler comprises hydrated alumina (ATH). Hydrated alumina produce a deep light translucent appearance. It has unique characteristics of onyx-like products. The alumina can be easily colored to any shade, can be blended with a particular filler, such as flakes, particles and the like which provide granite or marble-like appearance to the cured product. It is presently preferred to employ as ATH filler products known as hydrated alumina, sold under the catalog numbers OC 1000, OC 2000 and OC 3000 by Alcoa. OC 2000 is most preferred.

The matrix which contains the filler is provided by a thermoset polyester resin. The thermoset polyester resin preferably used is neopental glycol (NPG) isophthalic based resins modified with acrylic monomers to improve weathering and stain resistance. They are clear to light pink in shade, have a Brookfield viscosity of 500 to 600 cps with a No. 2 spindle at 20 rpms, a specific gravity of 1.5 and contain up to about 28% by weight styrene. The preferred polyester resin is S956 made by Sylmar Chemical Company. The catalyst used for curing is a peroxide catalyst, preferably methyl ethyl ketone peroxide.

The air release agent serves to degas the composition and cause entrained bubbles of air to rapidly rise to the surface during the coating process, and escape from the surface rather than being entrained in causing trapped bubbles during cure. Presently preferred air release agent is naphtha, light aromatic manufactured by BYK Chemie and sold as BYK A 555.

There is also employed a wetting agent which serves to enhance wetting out the substrate to maximize the bond to the substrate upon cure. Presently preferred wetting agents are naphthas, heavy alkanes, or isoalkanes sold as BYK-W 966 by BYK Chemie.

There may be included colored pigments, colored chips, UV absorbers, heat resistance modifier, other monomers which copolymerize with the polyester to modify properties of the cured resin. Such monomers include acrylic and methacrylic monomers.

The following are the presently preferred compositions for producing solid and granite like products.

Solid Color

38% NPG Isophthalic Enhanced Polyester Resin (Sylmar S956);

58% Alumina Trihydrate (ATH)—OC 2000 (Alcoa);

0.5% Naphtha Solvent (Air Releasing Agent);

0.5% Isoalkanes (Wetting Agent);

1% Methyl Ethyl Ketone Peroxide (Catalyst);

2% Color Pigment.

Granite-Like Color

38% NPG Isophthalic Enhanced Polyester Resin (Densified Resin);

30% ATH—Alumina Trihydrate;

30% Colored Chips (ATH—color dyed—coarse particle size);

0.5% Naphtha Solvent (Air Releasing Agent);

0.5% Isoalkanes (Wetting Agent);

1% Methyl Ethyl Ketone Peroxide (Catalyst).

Method of the Invention

The polyester resin is introduced to a mixing vessel following by slow edition of filler and any chips, air release agent, catalyst, and wetting agent. For forming a solid color surface via hydrated alumina is added along or preblended with its colorant. The granite like products the ATH is pre-mixed with the color chips for adding to the resin.

Variations of color and design for the mixture can be achieved by using different colored chips and fillers, and by changing the percentage of resin, filler, colored chips, catalyst and wetting agent. As such, the portions of fillers can be adjusted accordingly to obtain the desired effect.

The substrate, preferably MDF board or plywood for rigidity, becomes part of the product. The substrate is prepared by placing a frame such as a metal frame with a border rim on a flat surface such as a table with a vibrator attached. Ultrasonic energy may also be used. The board is then placed inside the frame with its edges resting upon the bottom rim. The edges of the frame are higher than the thickness of the board providing a form (border) for the deposited composition.

The liquid curable composition is poured onto the board within the form, and the vibrator is activated until the mixture is evenly spread over the board. Vibration assists in spreading the mixture evenly on the substrate and allows the mixture to be wet and absorbed onto and tightly bonded to the substrate. Gel time is about 30 minutes during which entrained air escapes from the surface. Inlays may, as indicated above, be added to the board prior to or after applying the liquid curable composition.

Curing may be achieved through stacking the boards onto a multi-level rack. This rack is then moved to a closed heating chamber for about 2 to 12 hours or preferably about 2 to 3 hours at about 160° to 185° F. Other methods of curing include exposure to sunlight. After the formed densified solid surface is cured, the board is sanded to give it a smooth, shiny look and to achieve the desired height.

In a typical manufacturing operation, a 4'×8' medium density fiberboard is coated with composition to a thickness of about ⅛" inch vibrated about 5 to about 15 minutes at ambient temperature until the coated composition uniformly spreads over the surface. Flow and gel times will vary with the humidity or temperature. There may, at times, be employed at leveling screed to assist in spreading.

After cure, the surface can be polished but it typically requires some degree of sanding and sanding is used a positive step to reduce thickness to a desired height for joining with other boards. A 100 to 220 grit sander is generally employed. A 1200 grit sander would provide a high gloss finish. Sanding can be used to reduce thickness by 25% or more. Buffing can also be used. Boards are typically cut to 24–25 inches wide for counter insulation and there may be added a bull nose edge molding with same or different materials and the splash board of the same or different materials. Boards can be bonded with the composition used for the surface or vinyl based glues.

The compositions of the invention can be equally applied to woven fiberglass or tile board to obtain free standing wall coverings, cast clay tiles to obtain a chip free surface their would use the same material as a grout between the tile to obtain a seamless look.

The method of this invention is the reverse of methods employed in the prior art. There is no employment of a fiberglass mold. Instead the substrate and applied frame and free air define the "mold." The substrate becomes a part of the final product. The material poured on top of the substrate becomes the laminated surface of the product. The composition gives a perfect surface free of any bubbles, pin holes, etc, which cannot be achieved with its materials of the prior art because of significant compositional differences.

EXAMPLES AND CONTROLS

There was use in the following examples and controls: a thermosettable polyester resin, known as NPT Isophthalic Enhanced Polyester Resin (Sylmar S956) manufactured by Sylmar Chemical Company. As a filler, there was employed hydrated alumina (ATH), sold by ALCOA, known as the OC 2000. As the air release agent, a Naphtha light aromatic defoamer provided by BYK Chemie and sold as BYK-A 555. As a wetting agent there was employed a heavy alkaloid naphtha manufactured and sold by BYK Chemie as BYK W966 and as the catalyst methyl ethyl ketone peroxide (MEKP). Except as otherwise shown, the substrate employed was medium density particle board (MDP board). The composition in each instance was blended to form a liquid which there was suspended filler deposited which was a mixture of the hydrate alumina alone or hydrated alumina and particulate colored chips (Gruber). The liquid compositions were blended and poured onto the surface of the substrate spread as required by hand or with a screed, subjected to vibration to cause flow and allowed to gel, then cured for two to three hours at 165°–180° C.

Example 1

The composition was based on 6 parts by weight resin and 10 parts by weight filler and pink colorant. There was included 0.5% by weight wetting agent, 0.5% by weight air release agent and 0.5% by weight catalyst. An excellent product free of bubbles and aggressively bonded to the MDF board was formed.

Example 2

There was formulated 7 parts resin, and 3 parts by weight filler, plus wetting agent. Composition was colored white. When cured, the white color was uniformly throughout the cured composition, which polished to a high gloss surface of uniform white.

Example 3

Example 1 was repeated except that the filler was a 50—50 mixture of Alumina and color chips. Product finish was excellent.

Example 4

The composition employed was assert the Example 2 except there was not utilized a wetting agent. As with Example 3, colored chips were uniformly disbursed throughout the cured layer and the surface polished to a smooth, high gloss surface.

Control 1

There was use a composition in which resin to filler was in proportions of eight parts by weight resin to six parts by weight filler. The filler employed were chips alone. The chip settled out of the resin before cure leaving an uneven distribution of chip and unsatisfactory, cloudy appearance.

Control 2

There was employed 10 parts resin to eight parts by weight filler which was half color chips and half ATH. The product was cloudy and unsatisfactory.

Control 3

There was employed a composition of the prior art, namely a composition of 25% by weight resin, 73% filler and 2% catalyst. The filler was 50% color chips and 50% ATH. While mixed in a pourable form, it could not be spread over the surface of the substrate. Coverage which was incomplete and when cured, the surface was rough, displayed large amounts of peaks and valleys and was rough and could not be polished. It was totally unacceptable.

Control 4

The composition of Example 2 with 2% by weight catalyst was poured into a mold and the MDF board laid on top of the poured composition. Bond was so weak that the MDF board could be separated from the cured composition by hand.

What is claimed:

1. The process for the formation of a coated substrate which comprises:

(a) providing a fluid, curable composition comprising:
  (i) from about 20 to about 50% by weight of a curable polyester resin;
  (ii) from 0 to about 2% by weight of a wetting agent;
  (iii) from about 0.25 to about 1% by weight of an air release agent; and,
  (iv) a positive amount up to 2% by weight of a catalyst for curing said polyester resin, the balance of said composition being filler;

(b) providing a substrate having a surface with a raised frame extending above the surface forming a zone for receiving said composition;

(c) introducing said composition within said zone and imparting vibratory action while said surface and composition are substantially level for a time sufficient to cause said composition to substantially uniformly occupy said zone;

(d) gelling said composition; and (e) curing the composition for a time sufficient to bond said composition to said substrate and to form a composite of said substrate and cured composition.

2. A method claimed in claim 1 which wetting agent in the present amount from about 0.25 to about 1% by weight.

3. The method as claimed in claim 1 in which the wetting agent is present in amount of about 0.5% by weight.

4. A method as claimed in claim 1 in which through the air release agent is present in an amount of about 0.25 to about 0.5% by weight.

5. A method as claimed in claim 1 which the catalyst is present in an amount of about 0.5% by weight.

6. A method as claimed in claim 3 which the catalyst is present in an amount of about 0.5% by weight.

7. A method as claimed in claim 1 in which the composition cured for at least 2 hours at a temperature of 160° to about 180° F.

8. A method as claimed in claim 1 in which the composition is allowed to cure for about 2 to 3 hours at 160° to 180° F.

9. A method as claimed in claim 6 in which the composition is allowed to cure for about 2 to about 3 hours at 160° to 180° F.

10. A method as claimed in claim 1 in which the polyester resin is a neopental glycol isophthalic resin containing acrylic monomers and having a styrene content of about 28% by weight of the polyester resin.

11. A method as claimed in claim 9 in which the polyester resin is a neopental glycol isophthalic resin containing acrylic monomers and having a styrene content of about 38% by weight of the polyester resin.

12. A method as claimed in claim 1 in which the filler comprises alumina.

13. A method as claim in claim 1 in which in the filler comprises a mixture of hydrated alumina and a particulate colored chips.

14. A curable composition comprising:

(a) from about 20 to about 50% by weight, based on the total weight of the composition, of a curable polyester resin;

(b) from 0 to about 2% by weight, based on the total weight of the composition of a wetting agent;

(c) from about 0.25 to about 1% by weight based on the total weight of the composition, of an air release agent, the balance of said composition being filler, said composition undergoing cure upon the inclusion exclusive of up to about 2% by weight of catalyst.

15. A method as claimed in claim 1 which includes adding an inlay to the substrate prior to or after applying the curable composition.

16. A method of claim 2 which further includes adding a dripless edge to the composite.

17. A curable composition comprising:

(a) about 38% by weight of curable polyester resin;

(b) about 0.5% by weight of a air release agent comprising a naphtha solvent;

(c) about 0.5% by weight of a wetting agent;

(d) about 2% by weight of a color pigment; and (e) about 58% by weight of alumina hydrate, the composition being cured by the addition of about 1% by weight of peroxide.

18. A composition comprising:

(a) about 38% by weight of a curable resin;

(b) about 30% by weight of colored chips comprising alumina hydrate;

(c) about 30% by weight of alumina hydrate in addition to the alumina trihydrate of component (b);

(d) about 0.5% by weight of naphtha air release agent; and (e) about 0.5% of a wetting agent, and (f) up to about 1% by weight of a catalyst capable of curing the composition.

* * * * *

UNITED STATES PATENT AND TRADEMARK OFFICE

CERTIFICATE OF CORRECTION

PATENT NO. : 5,789,032
DATED : August 4, 1998
INVENTOR(S) : Hai Le Cong; Arthur Jack Grigler It is certified that error appears in the above-identified patent and that said Letters Patent is hereby corrected as shown below:

On the title page,

Item [73] Assignee, change "Sante Fe Springs, Calif." to -- Santa Fe Springs, Calif. --.

Column 1, line 26, after "Buser et al." insert a semicolon.

Column 1, line 27, after "issued Jun. 13, 1995" insert -- to Elmore et al. --.

Column 1, line 30, replace "Terable et al. and" with -- Terable et al; --.

Column 1, line 31, after "issued Nov. 14, 1995 to Ghahary" insert a semicolon.

Column 1, line 33, replace "Safas Corp." with -- Ghahary --.

Column 2, line 7, change "insure" to -- ensure --.

Column 2, line 39, replace "substrates" with -- substrate --.

Column 3, line 38, replace "until coating thickness reach" with -- until the coating thickness reaches --.

Column 3, line 39, replace "of" with -- as --.

Column 3, line 63, after "degassing" delete the parenthesis.

Column 4, line 61, replace "products the ATH is" with -- products are --.

Column 5, line 28, change "⅛" inch" to -- ⅛ inch --.

Column 5, line 34, after "used" insert -- as --.

Column 5, line 47, before "cast" insert -- to --.

Column 5, lines 47,48, replace "their would use the same material" with -- or used --.

Column 6, line 37, replace "assert the" with -- as used in --.

Column 6, line 44, change "use" to -- used --.

UNITED STATES PATENT AND TRADEMARK OFFICE

CERTIFICATE OF CORRECTION

PATENT NO. : 5,789,032
DATED : August 4, 1998
INVENTOR(S) : Hai Le Cong; Arthur Jack Grigler It is certified that error appears in the above-identified patent and that said Letters Patent is hereby corrected as shown below:

Column 7, line 29, after "claim 1" insert -- in --.
Column 7, lines 29-30, replace "in the present amount" with
-- is present in an amount --.
Column 7, line 32, before "amount" insert -- an --.
Column 7, line 33, after "which" delete "through".
Column 7, line 36, after "claim 1" insert -- in --.
Column 7, line 38, after "claim 3" insert -- in --.
Column 8, line 9, replace "claim in claim 1 in which in the" with
-- claimed in claim 1 in which the --.
Column 8, line 10, after "alumina and" delete "a".
Column 8, line 31, change "a air" to -- an air --.

Signed and Sealed this

Seventh Day of December, 1999

*Attest:*

Q. TODD DICKINSON

*Attesting Officer*

*Acting Commissioner of Patents and Trademarks*